US012507741B2

(12) United States Patent
Howenstein

(10) Patent No.: US 12,507,741 B2
(45) Date of Patent: Dec. 30, 2025

(54) SHOWER BRASSIERE

(71) Applicant: Abby Howenstein, Jefferson, SD (US)

(72) Inventor: Abby Howenstein, Jefferson, SD (US)

( * ) Notice: Subject to any disclaimer, the term of this patent is extended or adjusted under 35 U.S.C. 154(b) by 0 days.

(21) Appl. No.: 18/751,992

(22) Filed: Jun. 24, 2024

(65) Prior Publication Data

US 2025/0386880 A1 Dec. 25, 2025

(51) Int. Cl.
*A41C 3/00* (2006.01)
*A41C 3/02* (2006.01)
*A41F 1/00* (2006.01)

(52) U.S. Cl.
CPC ..... *A41C 3/0064* (2013.01); *A41C 3/0028* (2013.01); *A41C 3/0035* (2013.01); *A41C 3/02* (2013.01); *A41F 1/006* (2013.01)

(58) Field of Classification Search
CPC .... A41C 3/0064; A41C 3/0028; A41C 3/0035
USPC ..... 450/89, 81
See application file for complete search history.

(56) References Cited

U.S. PATENT DOCUMENTS 1,391,936 A * 9/1921 Bosky ..... A41C 3/00 450/1
2,289,679 A * 7/1942 Porter ..... A41C 3/144 450/57
2,624,049 A * 1/1953 Granne ..... A41D 10/00 450/67
2,628,356 A * 2/1953 Rosenfield ..... A41C 3/06 450/41
2,988,087 A * 6/1961 Krieger ..... A41C 3/06 450/81
5,119,510 A * 6/1992 Schilling ..... A42B 1/045 2/202
5,334,085 A * 8/1994 Shroff ..... H01J 9/04 445/51
5,862,527 A 1/1999 Trevino
6,338,665 B1 1/2002 Dawson
6,390,885 B1 5/2002 Brooks
6,446,268 B1 * 9/2002 Lazarian ..... A41F 9/00 427/256
7,118,444 B2 * 10/2006 Newman ..... A41C 3/0092 450/54
7,228,809 B2 * 6/2007 Angelino ..... D06M 23/18 156/181
D550,368 S 9/2007 Hankins
7,309,275 B1 * 12/2007 Morales ..... A41C 3/04 450/38
D640,420 S * 6/2011 Miller ..... D29/120.1
8,684,789 B2 * 4/2014 Gramelspacher ..... A41C 3/065 450/92

(Continued)

FOREIGN PATENT DOCUMENTS

WO WO2015195170 12/2015

*Primary Examiner* — Gloria M Hale

(57) ABSTRACT

A shower brassiere for protecting surgical wounds and wound dressings from water while the wearer showers includes a garment body which configured to be worn around a chest of the wearer. The garment body has a generally tubular shape with a top end and a bottom end which are open to an interior space of the garment body. The garment body also comprises a water impermeable material. Drawstrings are attached to the garment body which are operable to cinch the garment body against the wearer's body to seal an interior of the garment body from the surrounding atmosphere.

19 Claims, 6 Drawing Sheets

(56) References Cited

U.S. PATENT DOCUMENTS

| | | | | |
|---|---|---|---|---|
| 9,498,004 | B2 | 11/2016 | Farrell | |
| 9,516,905 | B2 * | 12/2016 | Pagnon | A41C 3/10 |
| 10,194,701 | B1 | 2/2019 | Tufts | |
| 10,231,492 | B1 * | 3/2019 | Bastug | A41C 3/10 |
| D987,934 | S | 6/2023 | McKeen | |
| 2003/0186620 | A1 * | 10/2003 | Kaye | A41F 15/005 450/86 |
| 2004/0215118 | A1 * | 10/2004 | Dumas | A61F 15/004 602/3 |
| 2005/0027277 | A1 * | 2/2005 | Mizutani | A61F 13/47209 604/385.101 |
| 2006/0010577 | A1 * | 1/2006 | Sarikelle | A41C 3/144 2/267 |
| 2012/0142253 | A1 * | 6/2012 | Javaid | A41C 3/04 450/80 |
| 2012/0144547 | A1 * | 6/2012 | Collins | A41D 13/1236 2/67 |
| 2015/0079876 | A1 * | 3/2015 | Betts | A41C 3/0057 450/78 |
| 2015/0342268 | A1 * | 12/2015 | Roy | A41C 3/065 450/92 |
| 2017/0273367 | A1 * | 9/2017 | Betts | A41C 3/12 |
| 2018/0317571 | A1 * | 11/2018 | Caden | A41C 3/0057 |
| 2023/0329360 | A1 | 10/2023 | Abbazia | |

* cited by examiner

SHOWER BRASSIERE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to brassieres and more particularly pertains to a new brassiere for protecting surgical wounds and wound dressings from water while the wearer showers.

(2) Description of Related Art Including Information Disclosed Under 37 CFR 1.97 and 1.98

Following surgical procedures such as mastectomies and lumpectomies, patients are faced with the challenge of bathing or showering without causing water, soap, and other contaminants from interfering with wound dressings or entering healing wounds. The prior art discloses brassieres for use after such surgical procedures, but many are aimed merely at providing support for drainage tubes or other articles without providing a solution that enables the patient to bathe or shower without risking infection or damaging wound dressings.

U.S. Pat. No. 10,194,701 discloses a brassiere which is water impermeable, includes a cavity for storing a drainage bulb or tube, and has a sealing strip for sealing off an area of the patient's body to prevent entry of water and other contaminants into wounds and wound dressings. However, the garment disclosed by the patent does not include features which allow the patient to adjust the seal against the patient's body and requires the garment to apply a compressive force when worn on the patient's body in areas which may cause discomfort for the patient.

The prior art fails to describe a brassiere with a generally tubular shape that includes drawstrings to seal water and soap from entering an interior of the brassiere. The prior art also fails to disclose such a brassiere which is shaped to avoid compression against the patient's breasts or nearby areas which may have healing wounds or are otherwise sensitive. The prior art also does not address such a brassiere which forms an aperture to facilitate access to the interior of the brassiere when the brassiere is worn. Such features address a need not met by the prior art.

BRIEF SUMMARY OF THE INVENTION

An embodiment of the disclosure meets the needs presented above by generally comprising a garment body which configured to be worn around a chest of a user. The garment body has a generally tubular shape with a top end and a bottom end which are open to an interior space of the garment body. The garment body also comprises a water impermeable material. A top drawstring is coupled to the garment body proximate the top end and is cinchable against the garment body to constrict the top end of the garment body.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
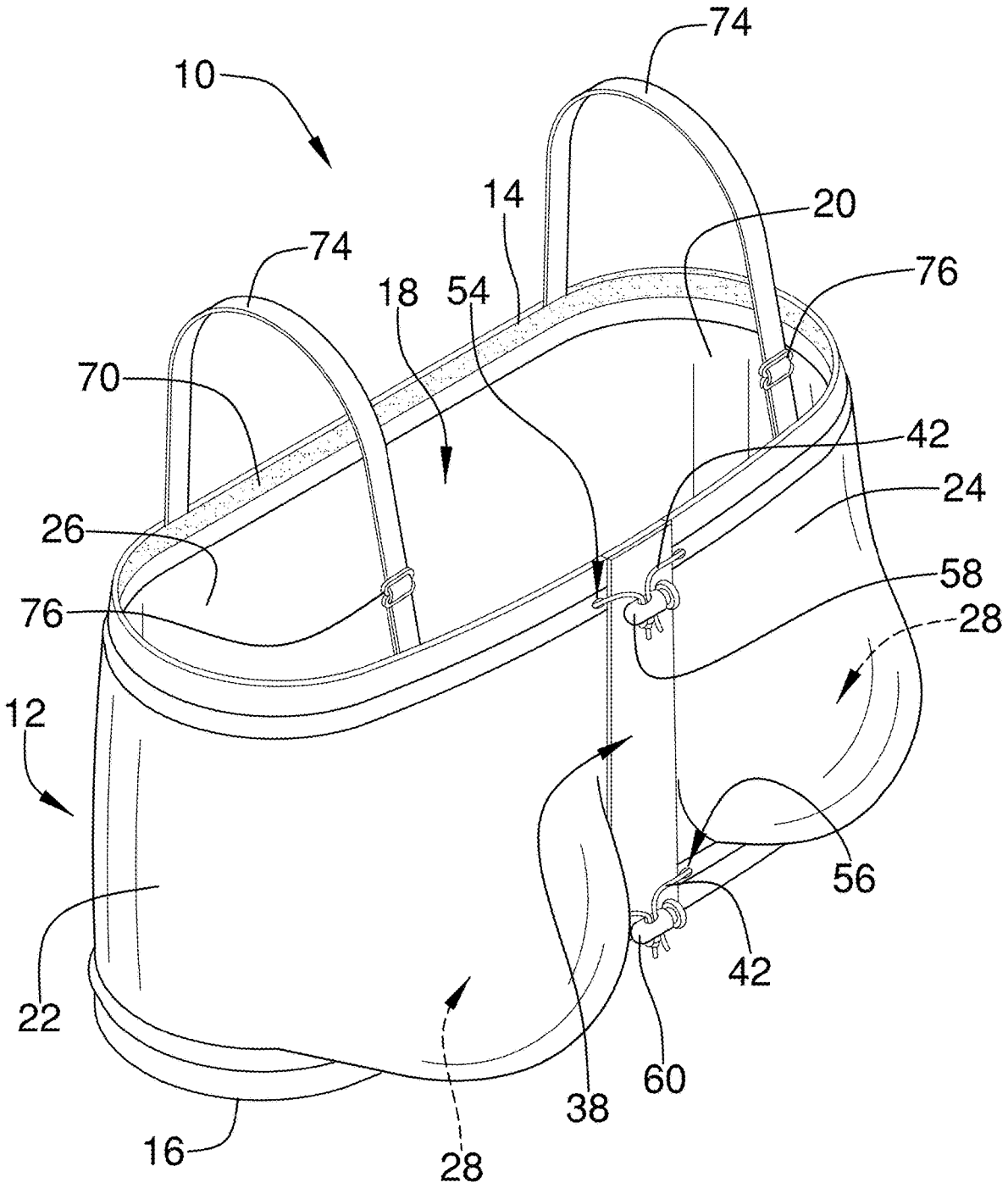
FIG. 1 is a perspective view of a shower brassiere according to an embodiment of the disclosure.
Figure 2:
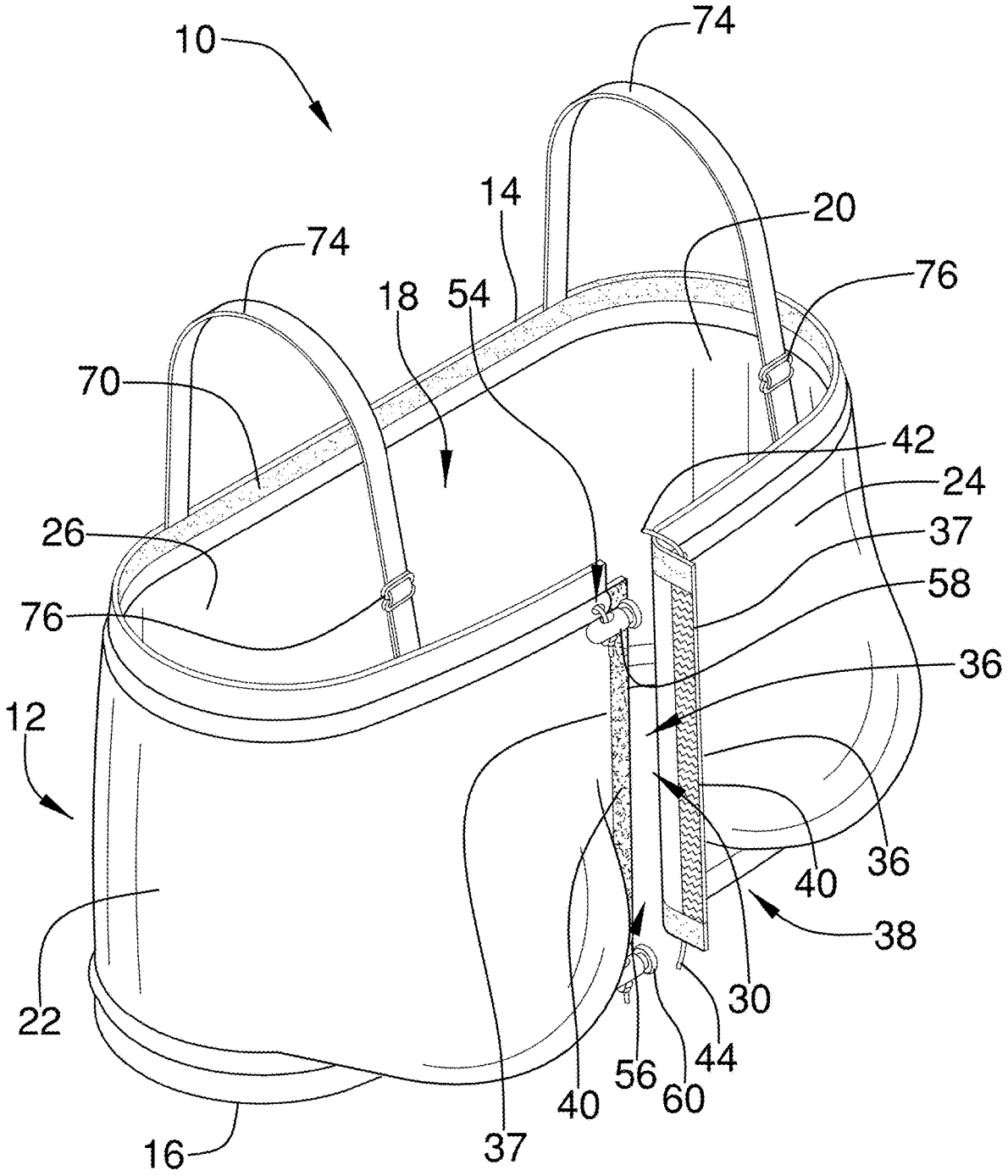
FIG. 2 is a perspective view of an embodiment of the disclosure.
Figure 3:
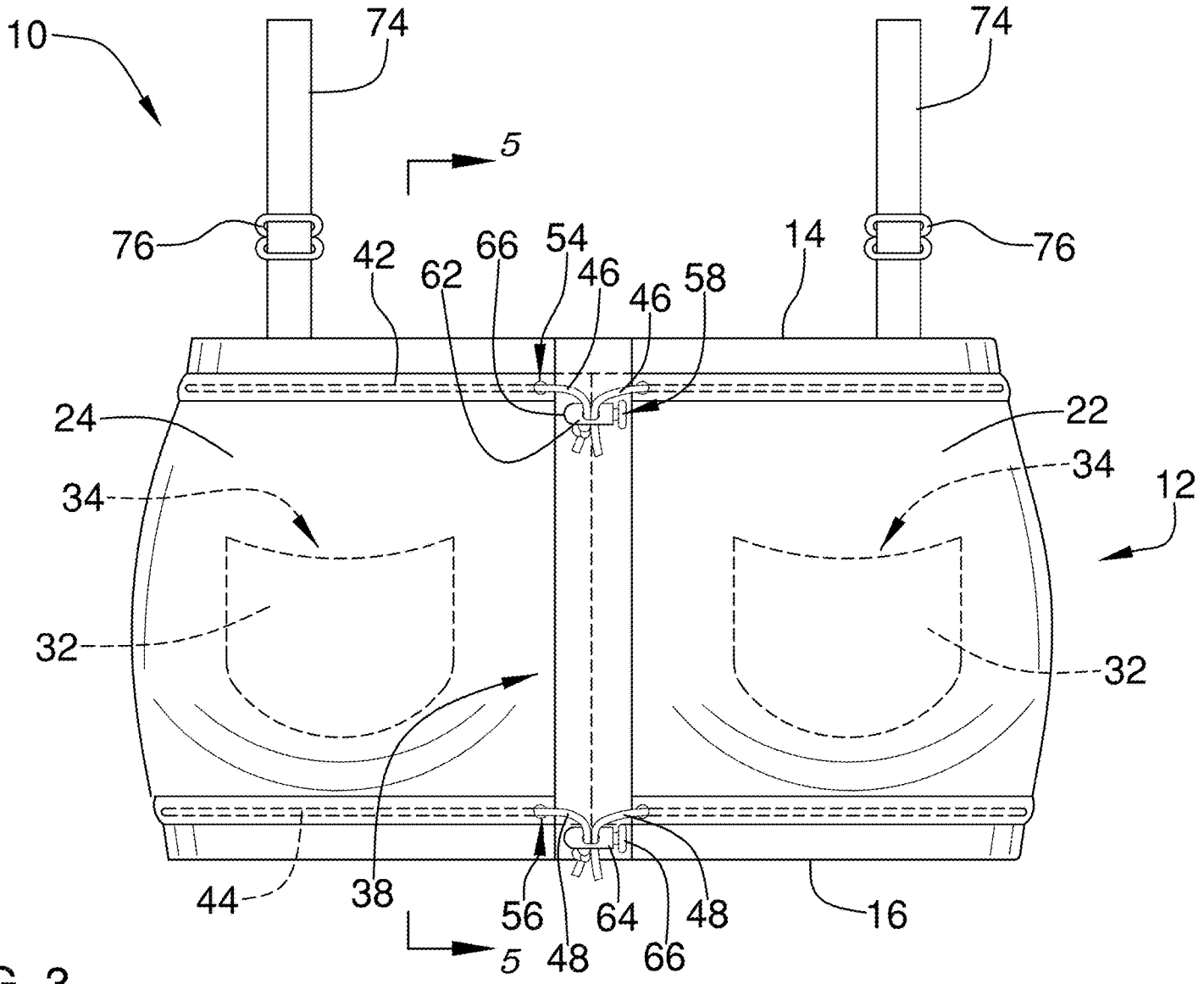
FIG. 3 is a front view of an embodiment of the disclosure.
Figure 4:
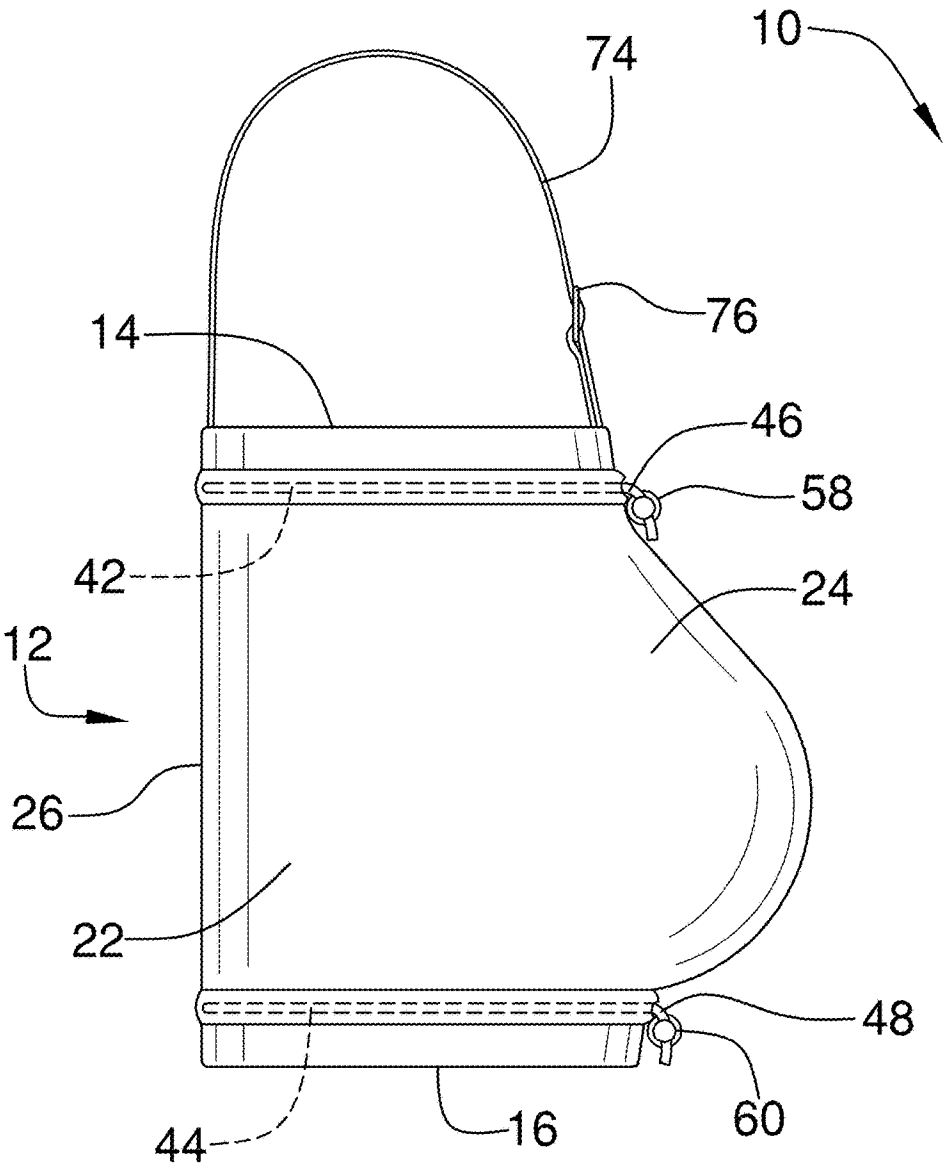
FIG. 4 is a side view of an embodiment of the disclosure.
Figure 5:
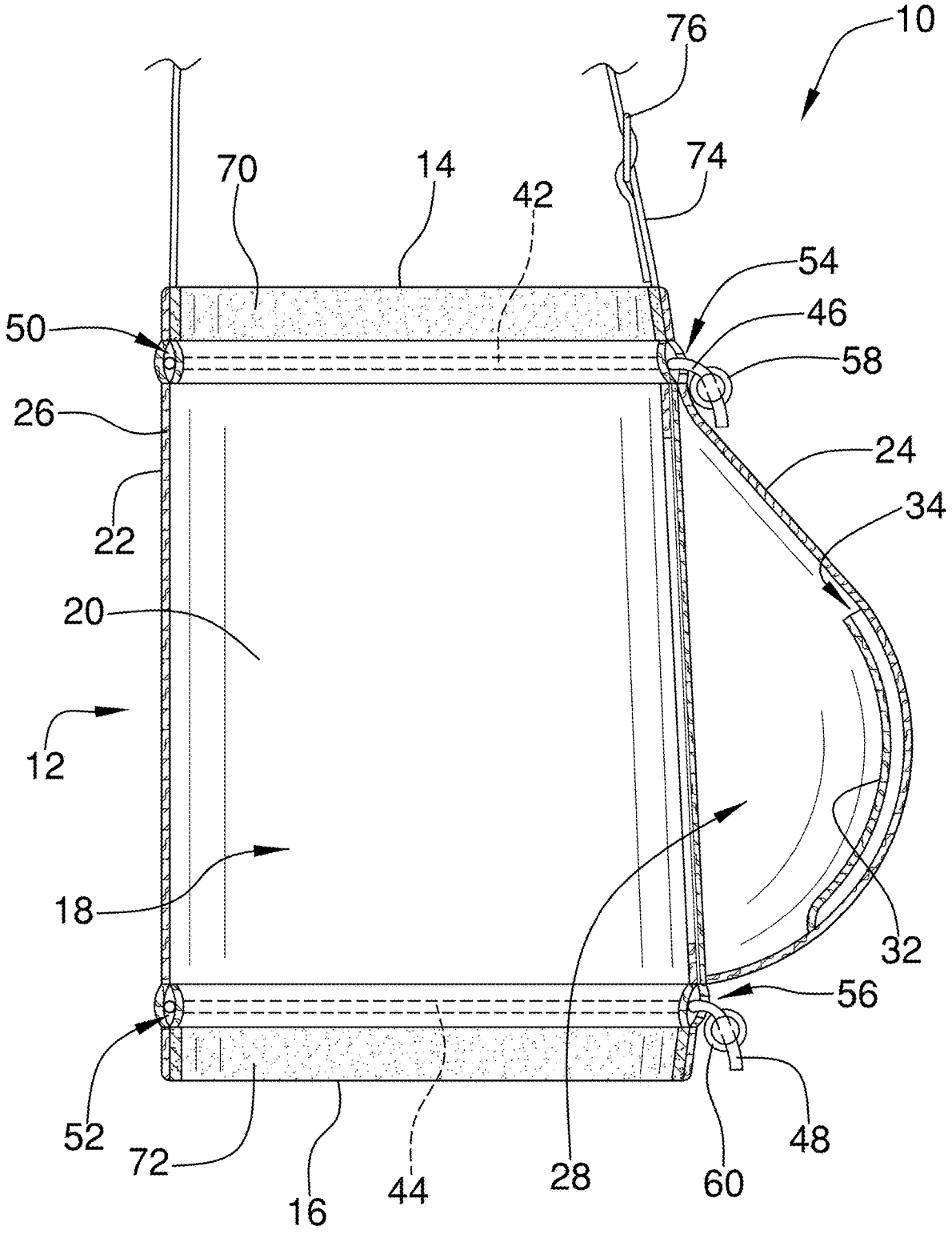
FIG. 5 is a cross-section view of an embodiment of the disclosure taken from Line 5-5 in FIG. 3.
Figure 6:
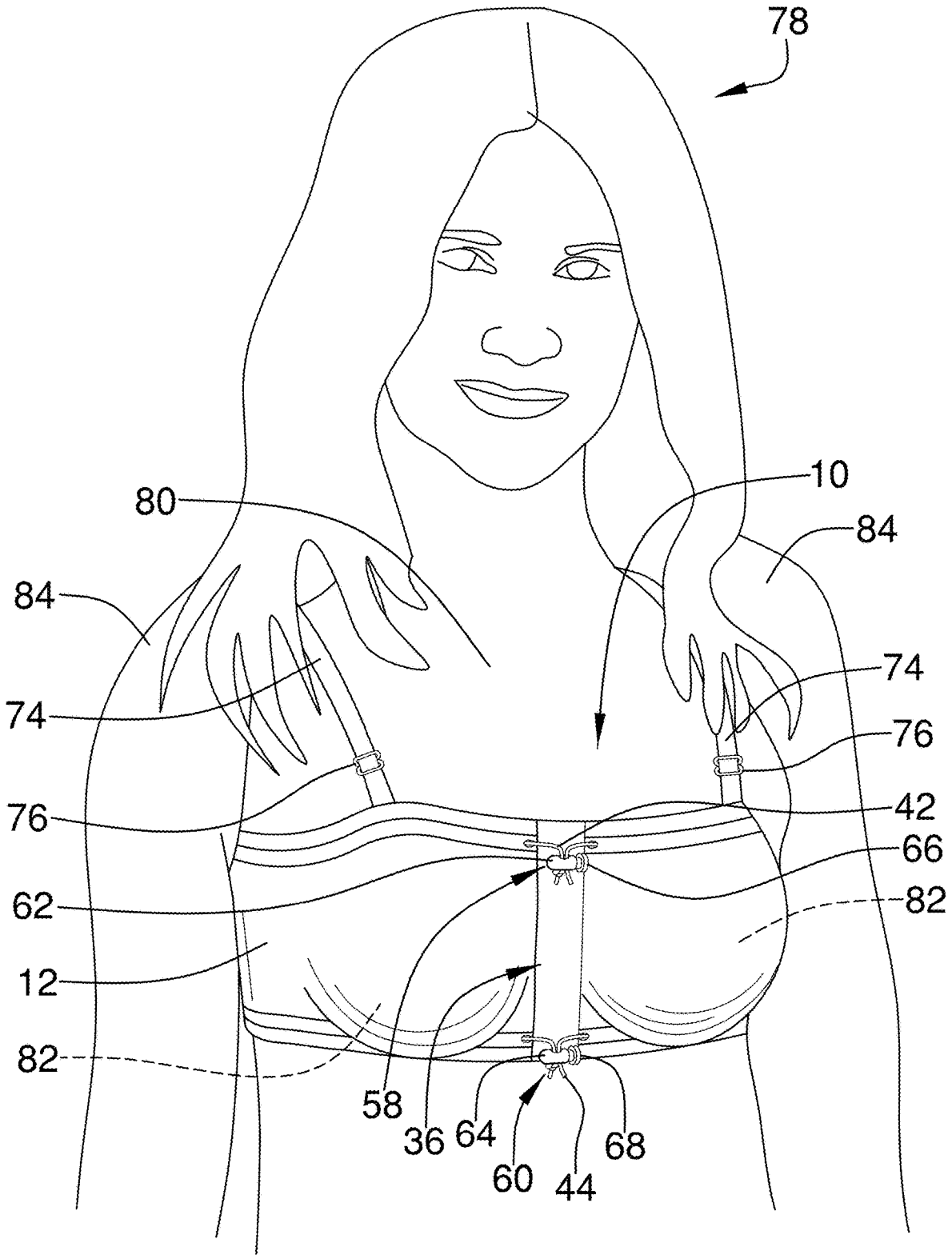
FIG. 6 is an in-use view of an embodiment of the disclosure.

With reference now to the drawings, and in particular to FIGS. 1 through 6 thereof, a new brassiere emgarment bodying the principles and concepts of an embodiment of the disclosure and generally designated by the reference numeral 10 will be described.

As best illustrated in FIGS. 1 through 6, the shower brassiere 10 generally comprises a garment body 12 configured to be worn around a chest 80 of a user. The garment body 12 has a generally tubular shape with a top end 14 and a bottom end 16 which are open to an interior space 18 of the garment body 12. The garment body 12 comprises a water impermeable material such as vinyl, polypropylene, polycarbonate, or the like. The garment body 12 defines a pair of recesses 28 on an interior side 20 and a front portion 24 of the garment body 12. The recesses 28 are laterally spaced from each other and are sized to accommodate the user's breasts 82. In some embodiments, a single recess 28 may be used to accommodate both breasts 82. Or, in similar manner, the garment body 12 may be generally wider in a central portion of the garment body 12 between the top end 14 and the bottom end 16. The garment body 12 is shaped as such in order to be worn around the chest 80 without compressing the user's breasts 82 or other portions of the user's body which are located between the top end 14 and the bottom end 16 of the garment body 12. In some embodiments, portions or all of the garment body 12 may be transparent, which may facilitate monitoring wounds, wound dressings, drainage tubes, and other articles in the interior space 18 of the garment body 12 when worn by the user. In some embodiments, ornamental designs may be printed or otherwise included on the garment body 12.

The garment body 12 has a break 36 therein which defines a pair of end edges 37 of the garment body 12. The end edges 37 are couplable together via a connector 38 to define the generally tubular shape. The connector 38 includes a pair of mating members 40, wherein each mating member 40 is mounted to and extends along an associated one of the end edges 37 of the garment body 12. The mating members 40 couple with each other to form a seal to prevent water, cleaning fluids, and the like from passing through to the interior space 18 of the garment body 12. The connector 38 comprises a hook-and-loop fastener but may but may comprise a zipper, snap buttons, or any other suitable fastener and may also include gaskets or other sealing devices to prevent the fluids from passing through the connector.

A pair of pockets 32 is mounted to the interior side 20 of the garment body 12. Each pocket 32 is positioned in an associated one of the pair of recesses 28 of the garment body 12 and has an opening 34 generally facing a same direction as the top end 14 of the garment body 12. The pockets 32 may be used to store drainage tubes or other parts of a wound dressing.

A top drawstring 42 and a bottom drawstring 44 are coupled to the garment body 12 proximate the top and bottom ends 14, 16 respectively. The drawstrings 42, 44 are cinchable against the garment body 12 to constrict the ends 14, 16 of the garment body 12, against the user 78. The drawstrings 42, 44 comprise a stretchable material such that they may be pulled against the user's 78 body without cutting uncomfortably into the user's 78 skin and to keep the ends 14, 16 of the garment body 12 cinched against the user's 78 body when the user 78 maneuvers the user's 78 body.

The top and bottom drawstrings 42, 44 extend through a top channel 50 and a bottom channel 52 respectively, each of which extends circumferentially with respect to the garment body 12. The channels 50, 52 may be formed by tubular segments of the garment body 12, by layers of material which are stitched together on opposite sides of the channels 50, 52, or by any other suitable means. The garment body 12 also defines a top slot 54 which extends through an exterior side 22 of the garment body 12 on the front portion 24 into the top channel 50 and a bottom slot 56 which extends through the exterior side 22 into the bottom channel 52. End segments 46, 48 of the drawstrings 42, 44 protrude forwardly from the garment body 12 through their respective slots 54, 56.

A top cord lock 58 and a bottom cord lock 60 are slidably mounted to the end segments 46, 48 of the top and bottom drawstrings 42, 44 respectively. The end segments 46, 48 may be pulled through the respective cord locks 58, 60 to cinch the respective drawstrings 42, 44. The cord locks 58, 60 may then be operated to secure the drawstrings 42, 44 in a cinched state. One of the end segments 46, 48 may be knotted in each of the top and bottom drawstrings 42, 44 so that the respective cord lock 58, 60 is retained on the respective drawstring 42, 44. The other end segment 46, 48 of each drawstring 42, 44 may then be threaded through the respective cord lock 58, 60 when the user 78 is ready to tighten the drawstring 42, 44.

Each cord lock 58, 60 comprises a receiver 62, 64 and a button 66, 68 which is slidably mounted in the receiver 62, 64. The button 66, 68 and the receiver 62, 64 form a gap therebetween through which the end segments 46, 48 of the respective drawstring extend, and the button 66, 68 is biased via a spring or other similar member to close the gap, thereby clamping the drawstring. Other locking devices may be used, including any of a variety of clamping devices or other fasteners. In some embodiments, the end segments 46, 48 may be tied together to secure the respective drawstring in a cinched state. Other cinching devices also may be used, such as adjustable straps with buckles or the like.

A top seal 70 and a bottom seal 72 are coupled to the interior side 20 of the garment body 12 proximate the top and bottom ends 14, 16 respectively. Each seal 70, 72 comprises a resilient material such as rubber, silicone, or the like, such that when the seal is constricted against the user's 78 body, the seal conforms to the user's 78 body to seal the interior space 18 of the garment body 12 from the surrounding atmosphere. The top seal 70 is positioned between the top end 14 of the garment body 12 and the top drawstring 42. The bottom seal 72 is positioned between the bottom end 16 of the garment body 12 and the bottom drawstring 44. In other embodiments, the top seal 70 may be positioned inwardly of the top drawstring 42, and the bottom seal 72 may be positioned inwardly of the bottom drawstring 44.

A pair of shoulder straps 74 is coupled to the garment body 12 at the top end 14. The shoulder straps 74 are laterally spaced from each other, and each shoulder strap 74 is coupled to and extends between a back portion 26 of the garment body 12 and the front portion 24 at the top end 14. Each shoulder strap 74 includes a slider 76 for adjusting a length of the shoulder strap 74.

In use, the user 78 wears the shower brassiere 10 before showering to prevent water from interfering with wounds or wound dressings on the user's 78 chest 80 or breasts 82. The garment body 12 is placed around the user's 78 chest 80, and the recesses 28 are positioned to receive the user's 78 breasts 82 therein. When donning the shower brassiere 10, the user 78 may disconnect the connector 38 and wrap the garment body 12 around the user's 78 chest 80 rather than sliding into the interior space 18 of the garment body 12 through the bottom end 16. Then the shower brassiere 10 may be secured on the user's 78 chest 80 by reconnecting the connector 38.

The shoulder straps 74 extend over the user's 78 shoulders 84 and may be adjusted in length as needed to position the garment body 12 as desired. The user 78 may place drainage tubes or other articles in the pockets 32. The drawstrings 42, 44 are cinched to press the seals 70, 72 into the user's 78 body, sealing the interior space 18 of the garment body 12 from the surrounding atmosphere. The user 78 may then shower as normal while preventing any water from interfering with wounds or wound dressings on the user's 78 body.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shower brassiere comprising:

a garment body configured to be worn around a chest of a user, the garment body having a generally tubular shape with a top end and a bottom end which are open to an interior space of the garment body, the garment body comprising a water impermeable material;

a top drawstring coupled to the garment body proximate the top end, the top drawstring being cinchable against the garment body to constrict the top end of the garment body; and a top seal coupled to an interior side of the garment body proximate the top end, the top seal extending circumferentially with respect to the garment body, the top seal comprising a resilient material configured to seal against the user inhibiting fluid to pass between the user and the top seal.

2. The brassiere of claim 1, wherein the top drawstring comprises a stretchable material.

3. The brassiere of claim 1, wherein the top drawstring extends through a top channel defined by the garment body which extends circumferentially with respect to the garment body, a pair of end segments of the top drawstring extending forwardly with respect to the garment body out of the top channel via a top slot defined by the garment body.

4. The brassiere of claim 1, further comprising a top cord lock operable to secure the top drawstring in a selected position with respect to the garment body, the top cord lock being slidably mounted on each of a pair of end segments of the top drawstring.

5. The brassiere of claim 1, further comprising a bottom drawstring coupled to the garment body proximate the bottom end, the bottom drawstring being cinchable against the garment body to constrict the bottom end of the garment body.

6. The brassiere of claim 5, wherein the bottom drawstring comprises a stretchable material.

7. The brassiere of claim 5, wherein the bottom drawstring extends through a bottom channel defined by the garment body which extends circumferentially with respect to the garment body, a pair of end segments of the bottom drawstring extending forwardly with respect to the garment body out of the bottom channel via a bottom slot defined by the garment body.

8. The brassiere of claim 5, further comprising a bottom cord lock operable to secure the bottom drawstring in a selected position with respect to the garment body, the bottom cord lock being slidably mounted on each of a pair of end segments of the bottom drawstring.

9. The brassiere of claim 5, further comprising a bottom seal coupled to an interior side of the garment body proximate the bottom end, the bottom seal extending circumferentially with respect to the garment body, the bottom seal comprising a resilient material configured to seal against the user.

10. The brassiere of claim 1, wherein the garment body defines a recess on an interior side and a front portion of the garment body.

11. The brassiere of claim 1, wherein the garment body defines a pair of recesses on an interior side and a front portion of the garment body, the recesses being laterally spaced from each other.

12. The brassiere of claim 10, further comprising a pair of pockets mounted to the interior side of the garment body, each pocket being positioned in an associated one of the pair of recesses of the garment body, each pocket having an opening generally facing a same direction as the top end of the garment body.

13. The brassiere of claim 1, further comprising a pocket mounted to an interior side of the garment body.

14. The brassiere of claim 1, wherein the garment body has a break therein which defines a pair of end edges of the garment body, the end edges being couplable together to define the generally tubular shape.

15. The brassiere of claim 14, further comprising a connector coupled to the garment body and configured to couple the end edges of the garment body together, the connector comprising a pair of mating members, each mating member of the pair of mating members being coupled to an associated end edge of the pair of end edges.

16. The brassiere of claim 15, wherein the mating members form a seal with each other when coupled together.

17. The brassiere of claim 1, further comprising a pair of shoulder straps coupled to the garment body, the pair of shoulder straps being laterally spaced from each other, each shoulder strap being coupled to and extending between a back portion of the garment body and the front portion at the top end.

18. The brassiere of claim 17, wherein each shoulder strap is adjustable in length.

19. A shower brassiere comprising:

a garment body configured to be worn around a chest of a user, the garment body having a generally tubular shape with a top end and a bottom end which are open to an interior space of the garment body, the garment body comprising a water impermeable material, the garment body defining a pair of recesses on an interior side and a front portion of the garment body, the recesses being laterally spaced from each other, the garment body having a break therein which defines a pair of end edges of the garment body, the end edges being couplable together to define the generally tubular shape;

a top drawstring coupled to the garment body proximate the top end, the top drawstring being cinchable against the garment body to constrict the top end of the garment body, the top drawstring comprising a stretchable material, the top drawstring extending through a top channel defined by the garment body which extends circumferentially with respect to the garment body, a pair of end segments of the top drawstring extending forwardly with respect to the garment body out of the top channel via a top slot defined by the garment body;

a top cord lock operable to secure the top drawstring in a selected position with respect to the garment body, the top cord lock being slidably mounted on each of the pair of end segments of the top drawstring;

a bottom drawstring coupled to the garment body proximate the bottom end, the bottom drawstring being cinchable against the garment body to constrict the bottom end of the garment body, the bottom drawstring comprising the stretchable material, the bottom drawstring extending through a bottom channel defined by the garment body which extends circumferentially with respect to the garment body, a pair of end segments of the bottom drawstring extending forwardly with respect to the garment body out of the bottom channel via a bottom slot defined by the garment body;

a bottom cord lock operable to secure the bottom drawstring in a selected position with respect to the garment body, the bottom cord lock being slidably mounted on each of the pair of end segments of the bottom drawstring;

a top seal coupled to the interior side of the garment body proximate the top end, the top seal extending circumferentially with respect to the garment body, the top seal comprising a resilient material configured to seal against the user inhibiting fluid to pass between the user and the top seal, the top seal being positioned between the top end of the garment body and the top drawstring;

a bottom seal coupled to the interior side of the garment body proximate the bottom end, the bottom seal extending circumferentially with respect to the garment body, the bottom seal comprising a resilient material configured to seal against the user, the bottom seal being positioned between the bottom end of the garment body and the bottom drawstring;

a pair of pockets mounted to the interior side of the garment body, each pocket being positioned in an associated one of the pair of recesses of the garment body, each pocket having an opening generally facing a same direction as the top end of the garment body;

a connector coupled to the garment body and configured to couple the end edges of the garment body together, the connector comprising a pair of mating members, each mating member of the pair of mating members being coupled to an associated end edge of the pair of end edges, the mating members forming a seal with each other when coupled together, the connector comprising a hook-and-loop fastener; and a pair of shoulder straps coupled to the garment body, the pair of shoulder straps being laterally spaced from each other, each shoulder strap being coupled to and extending between a back portion of the garment body and the front portion at the top end, each shoulder strap including a slider for adjusting a length of the shoulder strap.

* * * * *